US005782028A

United States Patent [19]

Simon et al.

[11] Patent Number: 5,782,028

[45] Date of Patent: Jul. 21, 1998

[54] CONCEALED SAFETY DEVICE FOR FIREARMS

[75] Inventors: Stephen G. Simon, 1167 E. Hillsboro Mile, No. 216, Hillsboro Beach, Fla. 33062; Denise E. Reed, Hillsboro Beach, Fla.; Charles W. Bergeron, Fort Lauderdale, Fla.

[73] Assignee: Stephen G. Simon, Deerfield Beach, Fla.

[21] Appl. No.: 359,067

[22] Filed: Dec. 19, 1994

[51] Int. Cl.[6] ..... F41A 17/26

[52] U.S. Cl. ..... 42/70.11; 42/70.08

[58] Field of Search ..... 42/70.06, 70.08, 42/70.11

[56] References Cited

U.S. PATENT DOCUMENTS

| | | | |
|---|---|---|---|
| 2,945,316 | 7/1960 | Mulno | 42/70.11 |
| 3,031,787 | 5/1962 | Womble | 42/70.11 |
| 3,376,088 | 4/1968 | Bol et al. | 312/319 |
| 3,673,725 | 7/1972 | Cravener | 42/70.11 |
| 3,899,845 | 8/1975 | Wild et al. | 89/135 |
| 3,903,631 | 9/1975 | Vesdmdd | 42/70.08 |
| 4,084,341 | 4/1978 | Cervantes | 42/70.11 |
| 4,499,681 | 2/1985 | Bako et al. | 42/70.11 |
| 4,763,431 | 8/1988 | Allan et al. | 42/70.11 |
| 4,858,799 | 8/1989 | Young | 224/243 |
| 4,934,083 | 6/1990 | Smith | 42/70.07 |
| 5,235,763 | 8/1993 | Nosler et al. | 42/70.11 |

FOREIGN PATENT DOCUMENTS

| | | | |
|---|---|---|---|
| 682124 | 10/1939 | Germany | 42/70.06 |
| 13802 | 7/1894 | United Kingdom | 42/70.06 |

*Primary Examiner*—Michael J. Carone

*Attorney, Agent, or Firm*—Malin, Haley, DiMaggio & Crosby

[57] ABSTRACT

The invention is directed to an apparatus (concealed safety device) and method for preventing unauthorized or inadvertent discharge of a firearm. The apparatus includes a plurality of annular pistons which are manipulated using a spring and hydraulic assembly. The pistons are attached to a annular engaging ring which works to obstruct the mainspring rod of a firearm when the apparatus is inserted into the associated firearm aperture. In operation, a quick manual pressure or strike to the right side of the gun handle through a concealed, thin-skinned, flexible wall allows for manual deactivation of the lock. When in the correct position the engaging ring blocks movement of the mainspring rod preventing the firearm's trigger from being pulled. The device is capable of installation at the time of manufacture or as an after-market accessory replacing the stock firearm grips.

11 Claims, 3 Drawing Sheets

CONCEALED SAFETY DEVICE FOR FIREARMS

BACKGROUND OF THE INVENTION

1. Field of the Invention

This invention relates to safety devices, particularly adapted for use with hand-held firearms such as handguns, pistols and the like, which allows the trigger mechanism to be blocked so that unauthorized users cannot fire the firearm. On the other hand, the authorized user can quickly manipulate a mechanical feature on the device to unblock the trigger mechanism in case a need arises for emergency use of the firearm. This is principally accomplished by providing pressure points principally located in the handgrip whereby properly applied pressure releases the blocked trigger mechanism, thereby enabling the trigger mechanism so that the firearm can be used. The pressure points maybe either hydraulic and/or mechanical programming device(s) which when installed obstruct firing mechanism(s) of the firearm until released. The device(s) can be integrated into the firearm when manufactured or may be implemented with existing firearms as an after-market (retrofit) accessory which may be installed by replacing the handgrips with a specially designed concealed safety device ("CSD"). The concealed safety device is not visible or detectable upon visual inspection of the firearm. Whereby, only an authorized user knows where the pressure points are located and in what combination or sequence pressure may be applied to release the trigger mechanism blocking device, thereby enabling the firearm to be fired. There are numerous benefits for the concealed safety device including the prevention of unauthorized use by children, thieves, and assailants.

2. Description of the Prior Art

The use of firearms for personal protection in home environments is becoming more common in today's society. This is especially true in urban areas where crime rates are high and many individuals feel the need to possess a handgun. However, the danger of possessing a legal firearm which may inadvertently be used, causing death and serious injury, offsets the benefits of owning and maintaining a firearm for protection. The concealed safety device of the present invention provides a safety system which protects against unauthorized use by providing a safety system that can be easily incorporated into, manufactured, or retrofitted firearm for minimizing the risk of unauthorized use. There is also an issue of personal liability of civil and criminal consequences should a authorized owner of a firearm fall into unauthorized use causing injury or death. Recently, many states have passed laws requiring a gun owner to be responsible for preventing unsupervised access to any firearm especially to a minor child. It is not uncommon to hear of the unauthorized use of an owners' firearm for criminal acts including but not limited to theft, homicide, suicide, or simply accidental discharge. In addition, law enforcement agents or private authorized owners always run the risk of having their firearm forcibly removed from their person or stolen and then used against them or others.

A major concern is that other members of a household, such as young children, can often locate firearms no matter how well they are concealed in the home. The CSD safety system still allows for quick use of a firearm while providing a basic safety system which in most cases will prevent an unauthorized user from gaining access to an operable firearm. A major goal of the inventor is to provide a concealed blocking device(s) for a firearm rendering it safe from unauthorized use while simultaneously allowing for almost immediate access and use by the authorized owner. Secondarily, the invention provides for a double safety device for accidental discharge of automatic firearms and some rifles and a primary safety for revolvers which do not typically possess any safety device for accidental firing. Numerous safety devices have been employed with guns to prevent unauthorized use, especially by children, in the home environment. The prior art shows several devices used with firearms to overcome the aforementioned mentioned problems. U.S. Pat. No. 4,084,341, issued to Ramon Cervantes, shows a detachable gun lock connected through the trigger mechanism. U.S. Pat. No. 4,499,681, issued to Lazio Bako, shows a security device for firearms that fits through the trigger guard. U.S. Pat. No. 4,858,799, issued to Duane Young, shows a three-way locking system for a handgun in a holster. U.S. Pat. No. 3,031,787, issued to S. C. Womble, Jr., shows a lock which passes through the trigger which must be actuated by a key. U.S. Pat. No. 4,934,083, issued to C. Martin Smith, shows a childproof lock for firearms which includes a detachable, keyless lock fitting over the trigger of the firearm. U.S. Pat. No. 4,763, 431, issued to Allan et al., shows a handgun locking and unlocking apparatus that utilizes electrical or mechanical pre-programming.

None of the devices disclosed by the prior art solve the problem of a concealed, quick-activating, safety device that blocks the hammer plunger and/or other firearm mechanisms and that can also be instantaneously released to activate the firearm for use while also providing a concealed safety mechanism to prevent unauthorized use. The present invention provides a firearm safety device(s) that can be used with a variety of weapons of different configurations and requires minimal knowledge of the operation of the device(s) for authorized use.

SUMMARY OF THE INVENTION

The present invention is drawn to a gun safety apparatus sometimes called a concealed safety device (CSD) which can be installed on a firearm, generally a handgun or rifle, at the time of manufacture or as an retrofit accessary. The concealed safety device in accordance with the present invention is in addition to a normal safety which is sometimes found on automatics which frequently blocks the sliding barrel of the automatic and is obvious and may be easily disengaged or accidentally disengaged in the course of handling the weapon. However, there are no safety devices commonly found on revolvers. The invention, in the retro-fit applications is designed to be incorporated into the handgrips of a pistol firearm. The external appearance of the handgun or pistol may be the same in that the present invention is typically concealed within the gun handgrip with the normal handle coverings hiding the present invention. The essence of the invention is that through quick manipulation of the present invention by knowing where to apply pressure or strike with a freehand with varying degrees of pressure or sequence, the main spring rod trigger blocking mechanism which is typically installed blocking the spring action of the gun's trigger device can be released as stated, thereby enabling authorized use quickly, efficiently, and cost effectively. The device includes two annular pistons. The first piston is a free-floating type which contacts the surface of hydraulic fluid. The second piston is an actuator piston which engages, through fluid communication, with the first piston to provide a surface for the user to provide force when deactivating the device. The first and second pistons are provided with a plurality of annular lip seals to prevent the escape of hydraulic fluid from an internal reservoir used in the housing. When installed, the concealed safety device is positioned within the firearm handgrip or butt. The blocking member is attached to the second piston, which is held in place by a mechanical return spring. The blocking member moves in accordance with the position of hydraulic fluid within the device. When the device is activated (safety on), the blocking member obstructs or blocks movement of the mainspring rod. In view of this obstruction, the trigger will not move and the firearm is incapable of being discharged. The device can only be deactivated (safety off) by providing a variable force to the mechanical return spring. When the requisite force is supplied manually, hydraulic fluid is drawn, from an internal reservoir positioning the blocking member so the mainspring rod is unobstructed.

To operate the device, one would first depress and/or strike a resilient location in the specially designed handgrip containing the invention which is typically concealed on the left side for right hand shooters or right side for left hand shooters and/or on the butt of the handgrip so that the concealed safety device (CSD) may be deactivated (safety off) by the shooters free hand. Otherwise, the firearm cannot be used. Should a child or other unauthorized user accidently or purposely obtain access to the gun, the unauthorized user will not know the position of or how to manipulate and in what sequence the concealed safety mechanism(s) in the handgrip in order to deactivate (safety off) the safety device allowing the gun to be fired. The authorized user, conversely, can use the firearm in an emergency with one or more motions of the hands by applying pressure and/or by striking a resilient area, typically located in the handgrip, thereby deactivating the concealed safety device (CSD) in the handgrip which then frees the main spring rod allowing the firearm to be fired.

The present invention, constituting the concealed safety device (CSD) for a firearm, can be initially manufactured at the factory for new firearms which may include other location(s) of the trigger mechanism which may be blocked, shielded, or otherwise interrupting or blocking either the trigger mechanism, firing pin, and/or any other moving part of the firearm incorporating either CSD and/or other releasing devices which incorporate either the application of variable pressure, sequential combinations and/or other mechanical and/or hydraulic apparatus(s) incorporating these method(s). In the alternative, any existing firearm that does not contain the present method(s) and/or apparatus(s), a retrofit kit(s) shall be utilized with certain recommended and prescribed firearms based on the physical specifications of same with the entire concealed safety device (CSD) which is typically incorporated into the pre-molded handgrip or firearm stock to allow installation of the present invention. The device can be designed so that upon installation, the initial state of the device would be that the safety would be activated (safety on) so that the gun could not be fired to prevent unauthorized or accidental firing once it is installed. The overall objective is that if there is a failure of the device, such as a fluid leak of the hydraulic fluid, the gun would be in a state such that the safety is activated (CSD) and the firearm could not be fired.

The present invention may also include a form of tactile indicator which may project near the surface of a resilient handle portion which, by grasping the handgrip of the gun, the user would feel the protrusion on the palm of the hand grasping the handgrip that would indicate whether the firearm is either activated (safety on) or deactivated (safety off). Only an authorized user, of course, would correlate the tactile protrusion and recognize that the concealed safety device (CSD) was deactivated (safety off) in that condition. This enables the authorized user a simplistic yet effective method of determining whether or not the concealed safety device (CSD) system is in place preventing the use of the firearm or has been activated (safety on) rendering the firearm to be utilized. To accomplish this, a small metal rod or rigid piece projects from one of the actuating pistons near the surface through a small aperture which protrudes through the handgrip and/or through a resilient spot on the handgrip and felt on the palm of the firearm users hand which would normally indicate an activated (safety on) firearm.

Although the preferred embodiment shows the device having a single strike place using both hands, wherein the safety is deactivated (safety off) by striking a certain preselected area of the gun firmly once, it is also the goal of the inventor to incorporate a sequential deactivation (safety off) method and apparatus of the concealed safety device (CSD) by permitting two or more activating plungers that deactivate (safety off) the concealed safety device (CSD) in a sequence that would be known only to the user. This would require a combination of sequential steps only known to the user to deactivate (safety off) the firearm which constitutes a variable complex combination device (s) to further insure that the invention would not be defeated after its use became more commonplace.

The device shown in the preferred embodiment shows the safety device activated with a small lever that can be activated manually by depressing the lever through a very small, resilient portion of the handgrip on one side of the handgrip. To deactivate the safety device, on the opposite side of the handgrip is a plunger that can be struck firmly with one hand while the firearm is held in the other hand, causing the safety device to be deactivated, allowing the firearm to be ready for authorized use. The location of both the safety activating device and the safety deactivating device can be moved around the firearm handgrip location so that the device could be mounted in such a way that by striking the handgrip pressure point(s) with one hand firmly through a resilient cover, the safety device would be deactivated, allowing the firearm to be in condition for authorized use. A variety of different locations could be selected so that anyone having access to a concealed safety device firearm would not know either the location(s) of pressure points and/or combination of sequential steps to activate the use of the firearm.

In addition, when using a retrofit kit, or even in the factory, the use of one-way screws for encapsulating the concealed safety device in the firearm handgrip would be desirable to prevent unauthorized removal of the molded handgrip. Furthermore, the resilient rubber handgrips may contain false screws concealing a known combination or other locking device underneath preventing the removal of the handgrips by unauthorized user.

Therefore, it is the object of the invention to provide an apparatus and method hidden in a firearm in addition to a conventional safety which allows for the hidden obstruction of the movement of the mainspring rod in a firearm and/or obstruction and/or shielding of other moving device(s), thereby preventing the firing of a firearm by unauthorized users, while allowing an authorized user to quickly use the weapon.

It is a further object of the invention to provide an apparatus which may be inserted within an aperture, located within a handgrip for a firearm, to surreptitiously allow or prevent movement of the trigger and mainspring assembly by manually actuation.

It is yet another object of the invention to provide an apparatus and method which can be retrofitted into a concealed safety device (CSD) and attached to the handgrip of a firearm and acts to obstruct movement of the trigger and mainspring rod to prevent discharge of the firearm with expeditious release by an authorized user.

It is still yet another object of the invention to utilize an annular piston assembly and the properties of a hydraulic fluid to provide an apparatus which engages and obstructs the mainspring rod assembly of a firearm to prevent discharge thereof while being a quick safety release by an authorized user.

In accordance with these and other objects which will become apparent hereinafter, the instant invention will now be described with particular reference to the accompanying drawings.

DESCRIPTION OF THE PREFERRED EMBODIMENTS

Figure 1A:
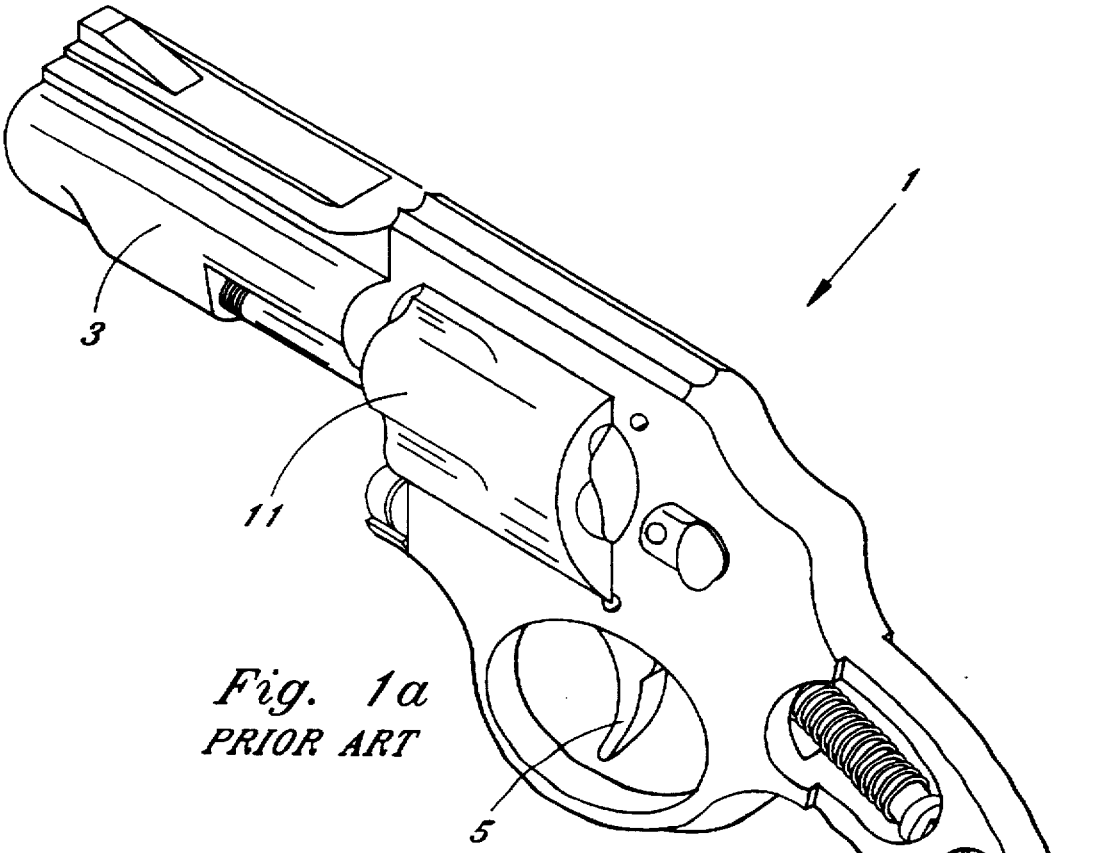
Fig. 1a PRIOR ART
FIGS. 1*a*, 1*b* and 1*c* illustrate side prospective and isometric views of a handgun with firing piston shown in alternative positions as used with the instant invention.
Figure 1B:
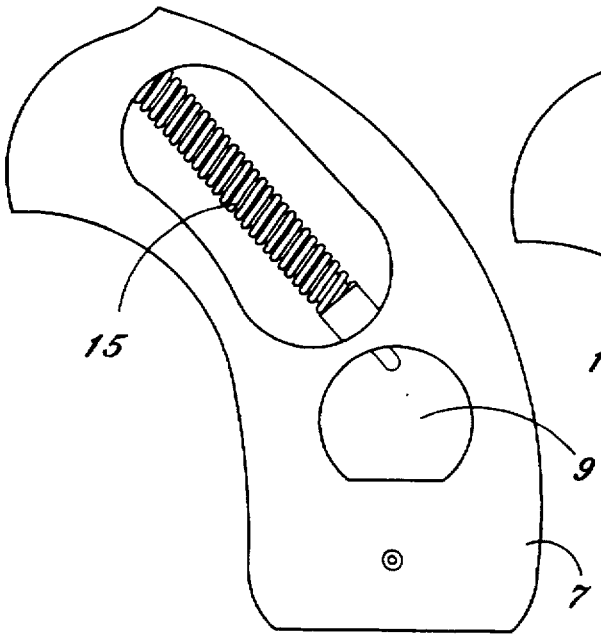
Fig. 1b PRIOR ART
Figure 1C:
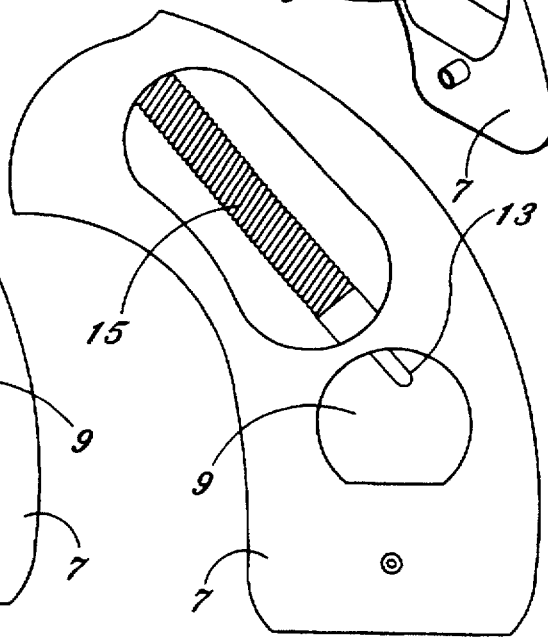
Fig. 1c PRIOR ART

Referring first to FIGS. 1*a*–1*c*, there is shown a typical handgun which can be used with the device of the present invention. FIG. 1*a* shows the firearm with hand grips removed. These grips typically include a housing with left and right plates. These plates cover the handle and are retained in position by some type of fastener such as a screw, locking device, or the like. In that the instant invention is intended to replace the existing gun grips, either at the time of manufacture or as an after-market accessory, the standard gun grips are not shown in these figures. Once the concealed safety device (CSD) is installed, one way screws could be used. On one side of the handle a resilient cover is used. On the other side a small resilient covering is employed, with a standard plate. Typically, the handle shell skin should appear normal, even if it is resilient or soft, but should have sufficient resistance to allow the gun to be held reasonably tight, without inadvertently deactivating the concealed safety device.

As seen in FIG. 1*a*, the firearm is shown generally at 1 and includes a barrel 3 and trigger 5. The butt end 7 of the firearm includes an aperture 9 which is essentially a circular void which passes directly through the butt end 7. It should be recognized that the aperture 9 can be any shape, semicircular or otherwise and is not limited by that depicted in FIG. 1*a*.

In order to fire bullets from cylinder 11, trigger 5 of the handgun is pulled, moving mainspring rod 13 in a plunging motion, into and out of piston aperture 9. Mainspring 15 surrounds mainspring rod 9 and acts to supply a biasing force to trigger 5 to prevent inadvertent firing. FIG. 1*b* shows mainspring rod 13 in its retracted position. This occurs when either the trigger 5 is in its static state or when the trigger is pulled fully rearward when the handgun has just been fired. FIG. 1*c* shows the mainspring rod 13 extended into piston aperture 9. It is important to note when mainspring rod 13 is blocked, it is not possible to pull trigger 5 and consequently the handgun is unable to be discharged. Additionally, and by way of example only, a revolver such as a "SIGSAUR" 9 mm Revolver is depicted herein. It should be recognized by those skilled in the art that the safety device of the present invention can be used with a wide variety of firearms which utilize a piston aperture and moveable mainspring rod. These include, but are not limited to revolvers, automatic firearms and rifles.

Figure 2:
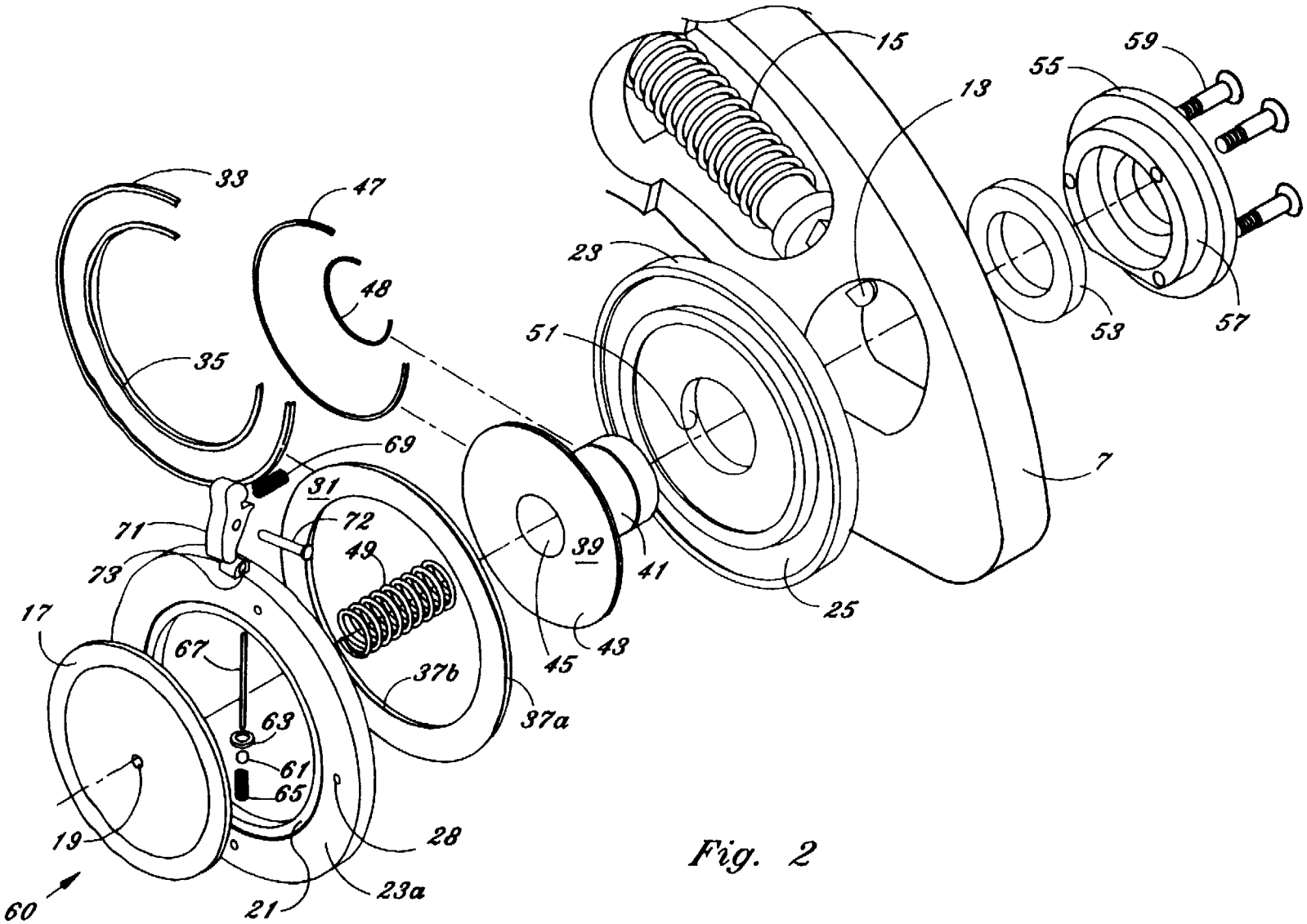
FIG. 2 illustrates an exploded isometric view of the present invention.

FIG. 2 illustrates the concealed safety component structure of the safety device in an exploded format used with a typical firearm. A number of components are shown which are intended to replace and/or fit within aperture 9 of the firearm 1 as a retrofit accessary. The mechanical assembly, as seen to the left of the firearm, comprise the left side components while components to the right of the handgun comprise the right side components.

The structure comprising the left handgrip is the bulk of the device. It includes hydraulic assembly plate 17 which is a flat circular surface and includes vent aperture 19 at its center point. Hydraulic assembly plate 17 is sized to fit within a recessed collar 21 of outer fluid reservoir assembly ring 23*a*. Outer fluid reservoir assembly ring 23*a* is shaped to include a hollowed interior void which when fitted with the inner fluid reservoir assembly ring 23 defines a hydraulic fluid reservoir there between.

A chamber floor (not shown) lies on the interior of the outer fluid reservoir assembly ring 23*a*. A plurality of chamber vents 28 communicate between the chamber floor (not shown) and the ambient environment. A free-floating annular piston 31 is sized to fit within outer fluid reservoir assembly ring 23*a*. An annular piston outer lip seal 33 and an annular piston inner lip seal 35 are fixedly attached to the outer surface 37*a* and inner surface 37*b*, respectively, of the annular piston 31 and allow hydraulic fluid which is placed within hydraulic fluid reservoir 25 to be trapped in a first chamber defined between these lip seals and hydraulic fluid reservior 25.

A second piston, that is actuation piston 39, is sized to fit within the circular void of annular piston 31. Actuation piston 39 has a unique shape and includes an elongated push member 41 upon which is attached a flanged member 43. Flanged member 43 is attached to an open end of actuation piston 39. Piston cavity 45 defines a closed end area between the elongated activating push member 41 and flanged member 43. An actuation piston edge lip seal 47 is fixedly attached to the outer edge of the flanged member 43 while actuation piston outer lip seal 48 is fixedly attached to the surface of elongated activating push member 41. Lip seals 47 and 48 work to contain and prevent escape of hydraulic fluid from a second chamber defined between these seals and surfaces 77 and 79. Thus, first and second chambers are variable volume hydraulic chambers present to hold hydraulic fluid. The position of the fluid will determine the position of annular piston 31, actuation piston 39 and engaging ring 53 described hereinafter. The position of these components determine whether the device is activated (safety on) or deactivated (safety off).

Further, return spring 49 is positioned within piston cavity 45 and provides a biasing force against the hydraulic assembly plate 17 to return actuation piston 39 to a fixed position when pressure is applied to elongated push member 41. Return spring 49 can be selected so as a strong or weak forces are required to move actuation piston 39 towards the hydraulic assembly plate 17. Ideally, return spring 49 should be selected to provide between 6 lbs. and 8 lbs. of biasing force. It should be recognized by those skilled in the art that the spring tension which is selected should be sufficient to prevent inadvertent discharge of the firearm by not allowing those unfamiliar or those unable to provide sufficient force to return spring 49 allowing engaging ring 53 to become disengaged and allow the device to be in the safety off position.

As mentioned above, inner fluid reservoir assembly ring 23, like outer fluid reservoir assembly ring 23*a*, includes a hollow interior void which defines a hydraulic fluid reservoir 25. Inner fluid reservoir assembly ring 23 includes an assembly ring aperture 51 sized to accommodate elongated activating push member 41. Finally, engaging ring 53 is press fit to the outer surface of elongated push member 41 described below. Engaging ring 53 is an annular blocking member which acts to directly block or obstruct mainspring rod 13 when in the proper position.

In order to permanently secure the device to the handgun 1, a housing ring 55 is included to fit on the right side of butt end 7, partially within piston aperture 9. Housing ring 55 includes a protruding edge 57 which frictionally engages within piston aperture 9. Once in proper position, a plurality of one way retaining screws 59 are inserted through corresponding apertures for engagement with threads on the inner portion of outer fluid reservoir assembly ring 23*a*. Retaining screws are securely tightened to firmly sandwich the assembly after hydraulic fluid has been injected within hydraulic fluid reservoir 25. Details of the actuation mechanism 60 are described in detail below.

Figures 3, 4, 5, 6:
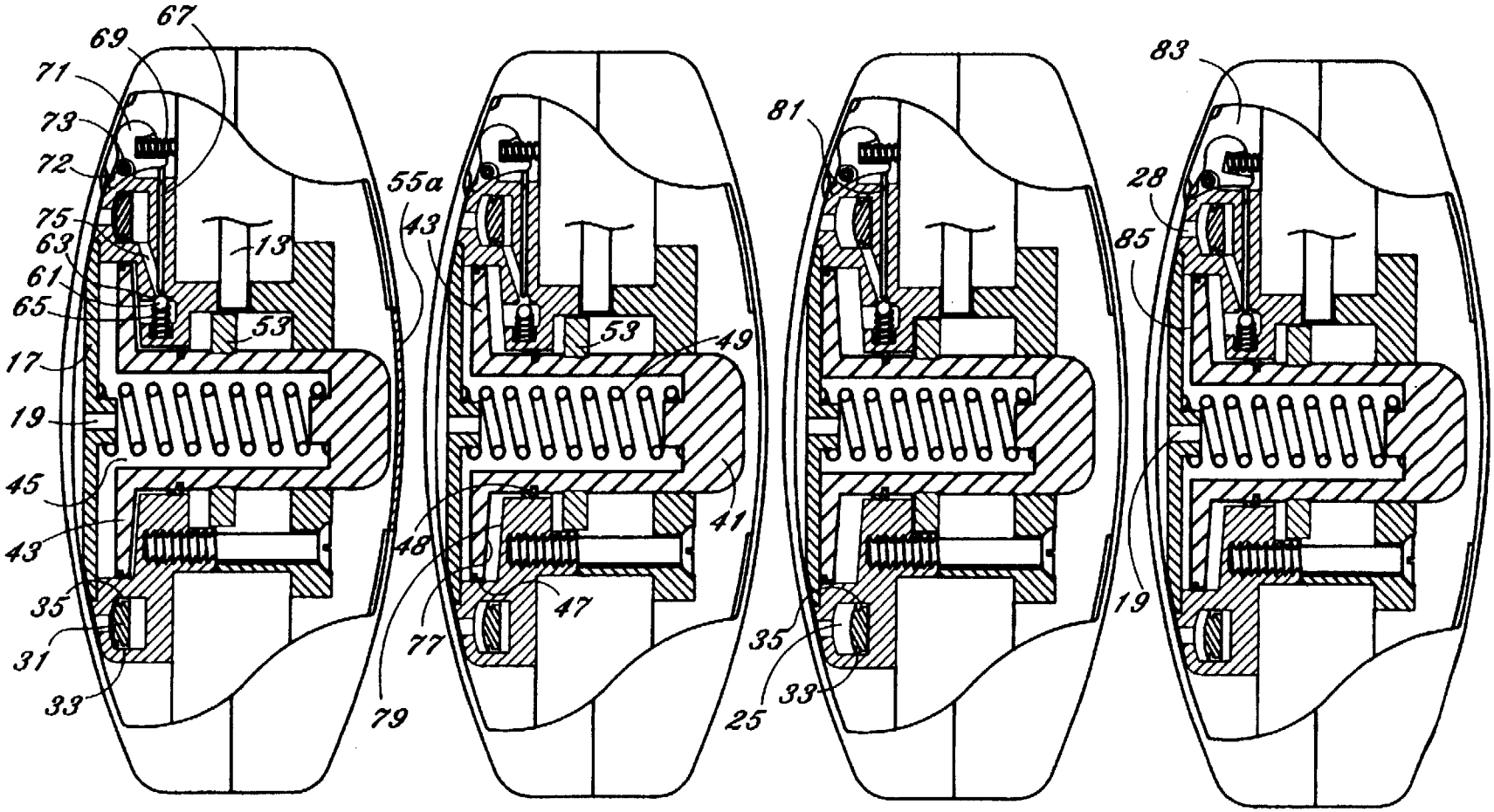
FIG. 3 illustrates a rear cross-sectional view of the present invention with the device with the safety on and the mainspring rod of the firearm blocked.
FIG. 4 illustrates a rear cross-sectional view of the present invention with the device in the safety on position and the engaging ring in transition before disengagement.
FIG. 5 illustrates a rear cross-sectional view of the present invention with the safety off with the engaging ring disengaged from the mainspring rod.
FIG. 6 illustrates a rear cross-sectional view of the present invention with the device partially re-engaged (safety on) and the engaging ring in transition before fully obstructing the mainspring rod as seen in FIG. 3.

FIGS. 3–6 show the operation of the safety device. Each of FIGS. 3–6 are rear cross sectional views of the device as seen in FIG. 2. FIG. 3 illustrates the mainspring rod 13 obstructed by engaging ring 53. In this configuration, the actuation mechanism for the safety device is easy visible. The actuation mechanism 60 is comprised of a ball 61, ball seat 63, ball seat spring 65, actuator push rod 67, actuator return spring 69, and pivotal actuator 71. Pivotal actuator 71 pivots about a fulcrum 73 where it is held by hinge pin 72 and biased against actuator return spring 69. Actuator return spring 69 is normally compressed and sandwiched in the outer fluid reservoir assembly ring 23*a* (FIG. 2) to provide a biasing force to the pivotal actuator by maintaining its position as seen in FIGS. 3–6. When pivoted about the fulcrum 73, actuator push rod 67 is forced downward where it contacts ball 61 forcing it off ball seat 63. Normally, in its static state, ball 61 is forced onto ball seat 63 by ball seat spring 65. In this position, ball 61 completely obstructs a channel 75. Channel 75 connects and allows fluid communication between the first chamber defined between outer annular piston outer lip seal 33 and inner annular piston lip seal 35 and fluid reservoir 25, and the second chamber created between actuation piston edge lip seal 47 and actuation piston outer lip seal 48 and surface 77 and 79.

It can be seen in FIG. 3 that the outer surface 77 of the flanged member 43 is positioned directly adjacent to the inner surface 79 of inner fluid reservoir assembly ring 23. Only a minute amount of hydraulic fluid is present between these surfaces. This works to create a suction force when these surfaces are separated. In this position, return spring 49 provides an outward biasing force against hydraulic assembly plate 17 wherein flanged member 43 is held in place; maintaining its fixed position against the inner surface 79 of inner fluid reservoir assembly ring 23. Since the engaging ring 53 is press fit to and moves with actuation piston 39, it is fixedly positioned under the mainspring rod 13. This obstruction prevents the firearm from being fired in view of the direct connection between the trigger 5, mainspring rod 13 and firing pin (not shown). In the event all fluid should leak from any of lip seals 33,35 or 47,48, engaging ring 53 would remain engaged with mainspring rod 13. Here, the hydraulic fluid does not exert pressure actuation on piston 39. Hence, the device is in a non-pressurized mode.

FIG. 4 illustrates movement of the component parts sliding from a position where mainspring rod 13 is partially blocked. Engaging ring 53 is shown having traveled one-half the distance to its disengaged, that is, safety off position. Engaging ring 53 and associated components continue in motion to stopping at the position shown in FIG. 5.

To achieve the deactivated position (safety off), the requisite amount of manual force must be applied to elongated activating push member 41. The force required to deactivate the safety device will be that to overcome both the biasing force of return spring 49 and to evacuate air trapped between the outer surface 85 of flanged member 43 and hydraulic assembly plate 17. This manually applied force allows trapped air to escape through vent aperture 19 which in turn creates an evacuating force sufficient to pull ball 61 off ball seat 63. This allows the hydraulic fluid to pass through channel 75 where it then holds flanged member 43 into a position where mainspring rod 13 is unobstructed by engaging ring 53. A quick manual pressure or strike to the right side of the gun handle through a concealed, thin-skinned, flexible wall 55*a* allows manual activation of push member 41.

FIG. 5 shows the firearm 1 in its fireable state (safety off). As can be clearly seen, the engaging ring 53 does not obstruct the mainspring rod 13. Hydraulic fluid from within hydraulic fluid reservoir 25 has passed between outer surface 77 and inner surface 79 thereby forcing the outer surface 85 of flanged member 43 against hydraulic assembly plate 17. Ball 61 has been returned to ball seat 63 by the biasing force of ball seat spring 65. Since a large amount hydraulic fluid has been drawn from the hydraulic fluid reservoir 25, air has entered through chamber vents 28 and free floating annular piston 31 has moved to a position flush against the inside surface of inner fluid reservoir assembly ring 23. Return spring 49 maintains a biasing force against hydraulic assembly plate 17 only to the extent that it is less than the force created by the hydraulic fluid against outer surface 77. Thus, contrary to that shown in FIG. 3, the hydraulic fluid is exerting pressure against actuation piston 39 and the device is in a pressurized mode. Actuation piston 39 maintains this rigid position and is not movable until the hydraulic fluid is able to escape through channel 75 by movement of the actuation mechanism 60. When hydraulic fluid is allowed to escape through activation mechanism 60, piston 39 is released into a nonpressurized mode and is moved, along with attached engaging ring 53, back to the locked position of FIG. 3, by return spring 49. In the event fluid should leak from lip seals 33,35 or 47,48, it would act similarly to the release of hydraulic fluid through activation mechanism 60, and allow piston 39 to be released into a nonpressurized mode by return spring 49 thereby moving engaging ring 53 to the safety position, engaged with mainspring rod 13. The firearm would remain in a non-fireable state.

FIG. 6 shows movement of components necessary to reengage the engaging ring 53 to activate the safety device. In FIG. 6, the manually activated pivotal actuator 71 has been manually rotated and actuator push rod 67 has forced ball 61, off ball seat 63, where channel 75 is unobstructed. Since channel 75 is open, the force created by return spring 49, rapidly returns the hydraulic fluid from the second variable volume hydraulic chamber defined by seals 47 and 48 and surfaces 77 and 79, back into the first variable volume hydraulic chamber defined by fluid reservoir 25 annular piston outer lip seal 33 and annular piston inner lip seal 35. In order to prevent fluid escape from the actuator assembly, an actuator push rod lip seal 81 prevents hydraulic fluid, moving from the hydraulic fluid reservoir 25, from escaping through the raised pivot area 83 at the upper portion of the outer fluid reservoir assembly ring 23*a*. The fluid moves upwardly through channel 75 from between outer surface 77 and inner surface 79 and evacuates substantially all fluid between these surfaces. This again creates the suction seal shown in FIG. 3 and allows the actuation piston 39 and engaging ring 53 to travel inwardly to a position under the mainspring rod 13. Thus, engaging ring 53 as again been reengaged and the firearm is prevented for discharging due to blockage of the mainspring rod 13.

Once the device is installed either at the factory or as a retrofit, a typical firearm can be activated and deactivated as follows:

In the normal position the pivotal actuator 71 is depressed through a flexible member on the left side of the handle. That causes the engaging ring 53 to engage with the mainspring rod 13 of the firearm preventing the firearm from firing. This will be the normal safety position, safety activated in addition to the other safety. When looking at the firearm however one cannot tell from the handle how to either activate or deactivate the safety device that is concealed in typically the handle butt. The authorized owner will know where the pivotal actuators are located and/or sequence thereof and can manually depress the pivotal actuator to ensure that the firearm is safety activated. The firearm would thus be stored in this mode but yet be placed in a location for sufficiently quick access for emergency situations. The firearm need not be locked in a safe but could be in a hidden location known to the authorized user to prevent children from openly seeing the device even though it is in a safety mode. To deactivate the safety device the authorized user merely picks the gun up, manually applies pressure on the CSD device(s), typically the right side of the handle, causing the push member to deactivate safety in a matter of a second or so. Thus, the firearm can be made instantaneously ready to fire by sufficiently pressing or striking hard enough on the right side of the handle or bottom of butt with varying pressure in sequence and/or location. Again with the concealed safety device (CSD) an unauthorized user would not know how to deactivate the safety device and therefore could not fire the firearm.

It should be recognized by those skilled in the art that the invention has described herein may be used in a purely mechanical embodiment as shown in U.S. Pat. No. 3,376,088 which is herein incorporated by reference. That embodiment would use a barrel, plunger and series of springs creating a device to physically obstruct the mainspring rod of a firearm. Additionally, it should also be recognized that mechanical pressure actuated servos could be used and remotely positioned, on or adjacent to, the firearm.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus mounted within a firearm and hidden from external view for use with a firearm to prevent accidental or unauthorized discharge, said apparatus used to selectively control the movement of the main spring rod that actuates the firing of the firearm, comprising:

a manually actuated piston assembly including at least one piston for moving between a first and second position;

means for manually actuating said manually actuated piston assembly, said means being connected to said firearm and hidden from external view;

a blocking member attached to said at least one piston for obstructing the movement of said mainspring rod in said first position and allowing unobstructed movement in said second position, extending into a butt of said firearm; and whereby said mainspring rod moves with the pull of a trigger of said firearm and said blocking member is positioned to obstruct said mainspring rod when said at least one piston is positioned in said first position.

2. The apparatus according to claim 1, wherein said piston assembly comprises:

a housing, containing a predetermined amount of hydraulic fluid, said fluid moving said at least one piston into a predetermined position and enabling said piston to maintain a rigid position in relation to said mainspring rod.

3. The apparatus according to claim 1, wherein said piston assembly comprises:

a chamber containing hydraulic fluid;

a first annular piston for providing a first planar surface which contacts hydraulic fluid;

a second annular piston for engaging with said first annular piston for providing a second planar surface area;

a biasing means for engaging with said second annular piston for holding said second piston into a fixed position;

a deactuation member attached to said second annular piston and blocking member for providing a surface in which force is applied against said biasing means to move said second annular piston into a predetermined position; and wherein the movement of said second annular piston into said predetermined position draws said hydraulic fluid from said reservoir thereby moving said blocking member and obstructing said mainspring rod.

4. A hidden safety apparatus mounted within a firearm for preventing the unauthorized discharge of a firearm comprising:

a sealed housing containing a predetermined amount of fluid;

at least one piston assembly positioned within said housing and response to said fluid position for manually moving between a first and second position;

means for manually activating said piston assembly, said means connected to said firearm, said means in fluid communication with said piston, and said means hidden from external view;

a blocking member attached to said piston for obstructing the movement of a mainspring rod of a firearm trigger of said firearm when said piston is in said first position, and unobstructed movement in said second position.

5. The apparatus according to claim 4 wherein said sealed housing is sized to fit within an aperture located in a butt of said firearm.

6. The apparatus according to claim 4 wherein said sealed housing includes two annular members which are joined to define a fluid reservoir therebetween.

7. The apparatus according to claim 6 wherein said housing further includes a plurality of annular lip seals for preventing escape of said fluid from said reservoir.

8. The apparatus according to claim 4 wherein said piston assembly comprises first and second annular pistons, said first piston engages with said second piston for providing a planar surface whereby said the position of said first and second piston determine the position of said blocking member.

9. The apparatus according to claim 8 wherein said blocking member is fixedly attached to said second piston.

10. The apparatus according to claim 8 wherein said first piston directly contacts said fluid and said apparatus further comprises a biasing means positioned within said second piston for exerting a force against said second piston to maintain said second piston in a predetermined position.

11. The apparatus according to claim 4 wherein said sealed housing includes a plurality of lip seals therein which define a first and second fluid reservoir and said apparatus further comprising a ball seat assembly for allowing fluid to communicate between said first and second fluid reservoir whereby the position of said fluid determines the position of said blocking member.

* * * * *